United States Patent [19]

Theurer et al.

[11] 4,266,615

[45] May 12, 1981

[54] SELF-PROPELLED BALLAST CLEANING MACHINE

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 110,136

[22] Filed: Jan. 7, 1980

[30] Foreign Application Priority Data

Jan. 22, 1979 [AT] Austria ..... 454/79

[51] Int. Cl.[3] ..... E01B 27/06

[52] U.S. Cl. ..... 171/16; 104/2; 37/104

[58] Field of Search ..... 104/2, 7, 8; 37/104, 37/105; 171/16

[56] References Cited

U.S. PATENT DOCUMENTS 4,178,995 12/1979 Theurer et al. ..... 104/2

FOREIGN PATENT DOCUMENTS 1350436 4/1974 United Kingdom ..... 104/2

*Primary Examiner*—Richard A. Bertsch

*Attorney, Agent, or Firm*—Kurt Kelman

[57] ABSTRACT

A self-propelled ballast cleaning machine comprises a machine frame comprised of two frame parts having abutting ends. A pivotal connection is arranged between the abutting frame part ends to enable pivotal movement of the frame parts in vertical and horizontal directions, and hydraulic drives interconnect the abutting frame part ends to effectuate the pivotal movement in at least one direction. Three track-bound undercarriages respectively support the machine frame at the abutting frame part ends and the ends of the frame parts remote from the abutting ends. Mounted on the machine frame are a ballast excavation chain comprising a horizontal course immersible in the ballast below the track, a ballast screening mechanism for cleaning the ballast coming from the excavation chain, respective conveyors for redistributing the cleaned ballast and for removing the waste respectively coming from the ballast screening mechanism, and a track raising mechanism in the range of the horizontal course of the ballast excavating chain.

9 Claims, 3 Drawing Figures

SELF-PROPELLED BALLAST CLEANING MACHINE

Figures 1, 2, 3:
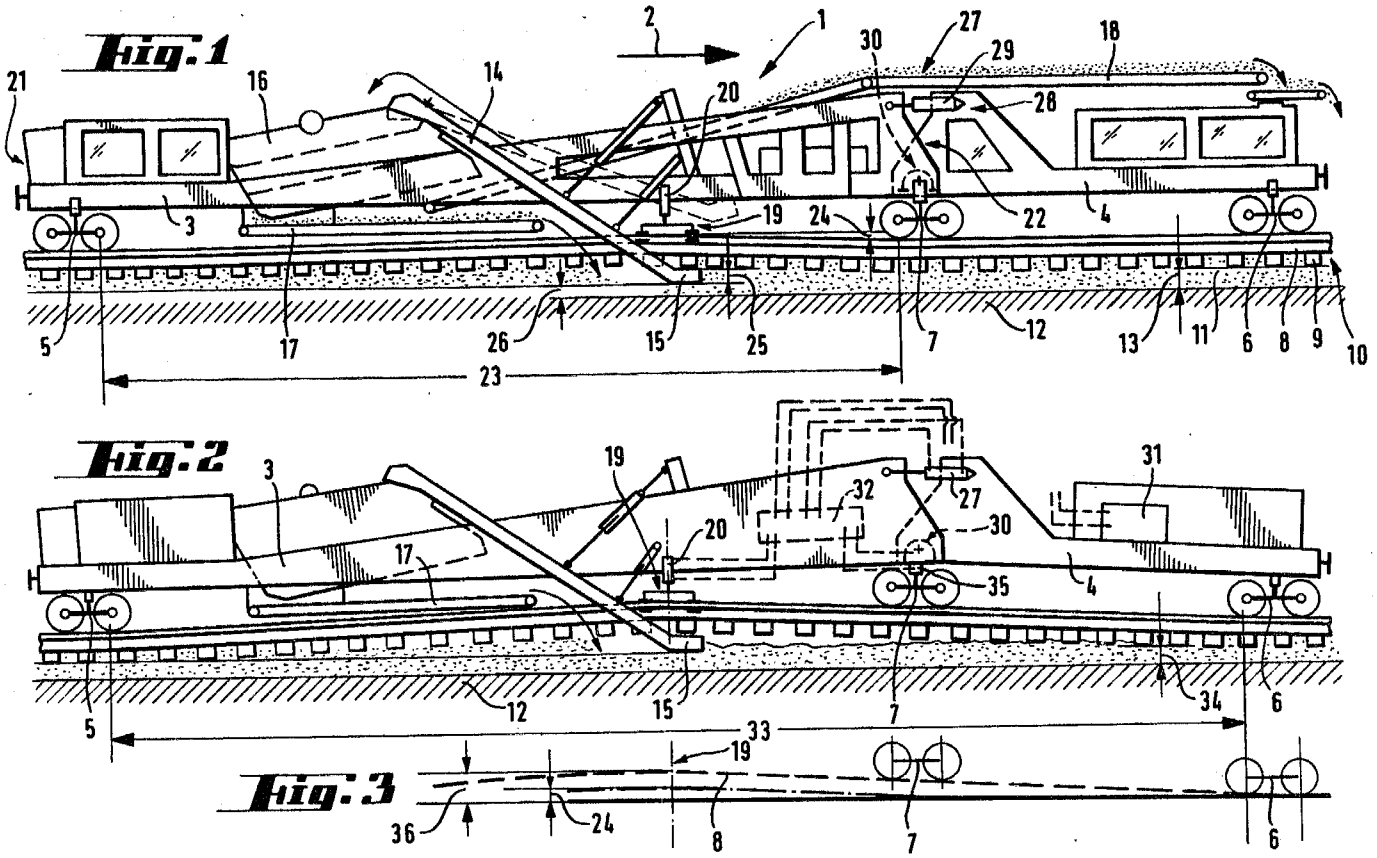

The present invention relates to a self-propelled machine for cleaning ballast supporting a railroad track.

British Pat. No. 1,350,436, published Apr. 18, 1974, discloses such a machine comprising such a ballast cleaning machine comprising a machine frame and two track-bound undercarriages supporting the machine frame on the track. Means is mounted on the machine frame for receiving the ballast, cleaning the received ballast and redistributing the cleaned ballast, this means including a ballast excavation chain comprising a horizontal course immersible in the ballast below the track, a ballast screening mechanism for cleaning the ballast and arranged to receive ballast from the ballast excavation chain, and respective conveyor means for redistributing the cleaned ballast and for removing waste, the conveyor means being arranged to receive the cleaned ballast and the waste, respectively, from the ballast screening mechanism. A device for raising the track, which may include means for laterally moving the track, is arranged in the range of the horizontal course of the ballast excavation chain. The thickness of the layer of ballast excavated by the generally triangular chain of this ballast cleaning machine cannot be less than the height of the horizontal course of the excavation chain digging through the ballast in which it is immersed under the track. Since the upper edge of the chain must be spaced a certain distance from the track ties under which the chain runs to avoid any damage to the undersides of the ties, it is not possible to obtain relatively small excavating depths desired by some railroads. The excavation of the ballast is considerably simplified and facilitated by raising the track in the range of the horizontal course of the excavation chain since this helps to avoid contact between the chain and the ties above the horizontal chain course, raising and laterally moving the track also serving to correct the track position, if desired.

In the known ballast cleaning machines of this general type, including the machine disclosed in the British patent, the track raising device is arranged substantially centrally between the ends of the machine frame. To enable the track to be raised sufficiently, the wheelbase of the machine must have a certain minimum dimension to make certain that the frame remains supported on the two track-bound undercarriages at the ends of the frame, the maximal lifting stroke being limited by the distance of the undercarriages from each other, i.e. those points of the track which receive the weight of the machine and wherebetween the track is raised. The maximal lifting stroke also depends on the flexing characteristics of the track rails, light rails being more readily lifted than heavy rails. Thus, since the track lifting stroke is limited in the conventional ballast cleaning machines, relatively thin layers of ballast cannot be excavated, such as may be required in a relatively shallow ballast bed in which a relatively thin layer of ballast is placed over the sub-grade of the railroad bed. But even where the ballast bed is of normal depth, efficiency or other economic considerations may make it desirable to excavate only a relatively thin layer of ballast for purposes of cleaning. Conventional ballast cleaning machines are not useful for this purpose because, even where the wheelbase would be sufficient to permit a relatively large lifting stroke, the structure is such as to inhibit operation of the track raising means beyond a relatively short stroke.

It is the primary object of this invention to improve ballast cleaning machines of the indicated type by imparting to them the capability of excavating thin layers of ballast, that is to excavate ballast to a very shallow depth only.

The above and other objects are accomplished in such a machine according to the invention with a machine frame comprised of two frame parts having abutting ends. A pivotal connection is arranged between the abutting ends of the frame parts to enable pivotal movement of the frame parts in vertical and horizontal directions, drive means interconnecting the abutting frame part ends and operable to effectuate the pivotal movement in at least one of these directions. Three track-bound undercarriages support the machine frame on the track, one of the undercarriages being arranged at the pivotal connection and being vertically adjustable with the two frame parts.

In this structure, the two frame parts may be simply spread apart by the drive means and can be raised in unison with the one undercarriage which has been added to the two undercarriages supporting the ends of the machine frame. In this manner, the wheelbase between the two end undercarriages required for the ballast excavation and raising of the track has been extended. Increased track lifting strokes make it possible to excavate very thin layers of ballast without incurring the danger of damaging contact between the running excavation chain and the track ties. On the other hand, when the machine travels between working sites, the machine frame is supported on all three track-bound undercarriages, thus assuring a desirable shorter wheelbase between undercarriages and distributing the heavy machine weight over three undercarriages. Generally, the ballast cleaning machine of the present invention will be used primarily in track sections with shallow ballast beds or under conditions where the core of the ballast does not require cleaning and it is merely desired to provide a renewed ballast surface for support of the track ties, particularly in connection with a simultaneous track leveling and lining operation.

The above and other objects, advantages and features of this invention will become more apparent from the following detailed description of a now preferred embodiment thereof, taken in conjunction with the accompanying schematic drawing wherein FIG. 1 illustrates a side elevation of a ballast cleaning machine according to the invention in operating position, FIG. 2 is a like side elevational view but somewhat simplified by omitting some structural details and showing the pivoting drive means in operation by means of a diagrammatically illustrated control arrangement associated with the drive means, the intermediate undercarriage being free of load, and FIG. 3 diagrammatically indicates the flexing of the track rails during operation of the machine according to FIGS. 1 and 2, i.e. with and without raised frame parts.

Referring now to the drawing, FIG. 1 shows self-propelled machine 1 for cleaning ballast 11 supporting railroad track 10 consisting of rails 8 fastened to ties 9. During operation, the machine moves in the direction of arrow 2. Machine 1 comprises a machine frame comprised of two frames 3 and 4 having abutting ends, frame part 3 constituting the rear frame part and frame part 4 constituting the front frame part, as seen in the operating direction. Pivotal connection 30 is arranged between the abutting ends of frame parts 3 and 4 to enable pivotal movement of the frame parts in vertical and horizontal directions. The pivotal connection may be a universal joint, for example a ball-and-socket joint, linking the two frame parts for movement in a horizontal and vertical direction. Drive means 27 interconnects the abutting frame part ends and is operable to effectuate the pivotal movement in at least one of the directions.

Three track-bound undercarriages 5, 6 and 7 support the machine frame on track 10, undercarriage 7 being arranged at pivotal connection 30 and being vertically adjustable with the two frame parts 3 and 4.

As shown in FIG. 1, ties 9 of the track are embedded in ballast 11, which supports the track, and the untreated portion 13 of the ballast bed has a certain thickness or depth between the undersides of the ties and sub-grade 12 on which the ballast is arranged. Generally, this ballast bed depth is between about 25 and 30 cm. Conventional means are mounted on the machine frame for receiving the ballast, cleaning the received ballast and redistributing the cleaned ballast, the illustrated means including ballast excavation chain 14 comprising horizontal course 15 immersible in the ballast below track 10, ballast screening mechanism 16 for cleaning the ballast and arranged to receive ballast from ballast excavation chain 14, and respective conveyor means 17 and 18 for redistributing the cleaned ballast and for removing waste, the conveyor means being arranged to receive the cleaned ballast and the waste, respectively, from the ballast screening mechanism. As can be seen, conveyor 17 moves the cleaned ballast to deposit the cleaned ballast directly in the cribs and under the ties in the excavated area of the bed while conveyor 18 moves the waste forwardly for storage in freight cars coupled to the machine or to be thrown onto the shoulders of the track bed. Conventional device 19 for raising the track is arranged in the range of horizontal course 15 of ballast excavation chain 14. As is well known, this device may include the schematically illustrated pairs of rail gripping rollers whose supporting frame is vertically movably mounted on rear frame part 3 by hydraulic drive 20. As is also well known, device 19 may further include means for laterally moving the track, which means may be another hydraulic drive extending horizontally.

As shown in the drawing, the track-bound undercarriages preferably are swivel trucks. In the preferred illustrated embodiment, distance 23 between swivel trucks 5 and 7 supporting respective ends 21 and 22 of rear frame part 3 is greater than the distance between intermediate swivel truck 7 and track-bound undercarriage 6 supporting respective ends of front frame part 4, the illustrated distance 23 being substantially twice the distance between swivel trucks 7 and 6. This ratio of the wheelbases of the two frame parts enable track raising device 19 to lift track 10 by a lifting stroke 24 indicated between the facing heads of two arrows. Raising the track causes the undersides of track ties 9 to be removed from contact with ballast 11, i.e. to be spaced farther from sub-grade 12. Therefore, transverse course 15 of excavation chain 10, which has a height 25 indicated between the facing heads of two arrows, must not be immersed in the ballast below track 10 by a depth corresponding to its full height. The relatively shallow immersion of horizontal chain course 15 means not only excavation of a thinner layer of ballast but also leaves a greater safety zone 26, indicated between the facing heads of two arrows, between the underside of the chain and sub-grade 12. This prevents the running excavation chain from damaging or removing protective layers of material that may be placed between sub-grade 12 and ballast 11. The described difference in the wheelbases of the two frame parts produces not only a favorable axle load when the machine frame is supported on all three undercarriages but it also assures a substantially even load on the two end undercarriages 5 and 6 when the machine is supported only on these undercarriages during the cleaning operation.

In the illustrated embodiment of drive means 27 is arranged to lock frame parts 3 and 4 in respective end positions of the pivotal movement and comprises two hydraulically operable cylinder-piston drives 28. Each drive 28 extends above pivotal connection at a respective side of the machine frame (only the drive on the visible side of the side elevational views of the drawing appearing thereon). Cylinder 29 of each drive 28 has an end linked to one of the abutting frame part ends, in the illustrated embodiment the end of front frame part 4, and the piston of each drive has an end linked to frame part end 22. The universal pivotal connection between the abutting ends of the two frame parts enables them to adapt their position exactly to the position of the track in vertical and horizontal directions, and assures a uniform distribution of the machine load over all three track-bound undercarriages.

The illustrated cylinder-piston drive enables the two frame parts to be vertically adjusted in relation to each other and the adjusted frame parts may then be locked in position by the hydraulic fluid in the cylinders. Depending on the prevalent track conditions, intermediate undercarriage 7 may remain engaged with the track rails and merely the frame parts may be raised by drives 28, which will assure a larger play between the track and the underside of rear frame part 3 in the range of track raising device 19. As illustrated, however, the machine may further comprise drive 35 for vertically adjusting the intermediate undercarriage in relation to the machine frame. Thus, after the two frame parts have been pivoted and locked in their pivoted position, hydraulic drive 35 may be operated to lift undercarriage 7 off track 10. With the lowered intermediate undercarriage, the machine of the invention will operate in the same manner as conventional ballast cleaning machines for general purposes.

The ballast cleaning machine of this invention will operate most effectively if the track-bound undercarriages supporting the machine frame on the track are swivel trucks and, as shown in the drawing, the means for receiving, cleaning and redistributing the ballast as well as the track raising device are mounted on rear frame part 3 of the machine frame. Such a structure satisfies all practically occurring track conditions with respect to the desired track lifting stroke required for excavating the ballast to a desired depth while providing additional space on front frame part 4 for housing the power plant for the various drives of the machine.

As shown in FIG. 2, operation of drive 27 to pivot frame parts 3 and 4 about universal joint 30 and thereby to spread the abutting ends of the frame parts apart will increase the lifting stroke of track raising device 19. Hydraulic fluid is delivered to cylinder 29 of hydraulic drive 28 and to lifting cylinder 20 of track raising device 19 from central sump 31, the fluid delivery being controlled by control valve arrangement 32 in the hydraulic fluid supply lines to lock the frame parts in their pivoted position and to raise the track by the desired lifting stroke. By spreading the abutting ends of frame parts 3 and 4 about pivot 30, these two frame parts with undercarriage 7 are lifted off track 10, i.e. away from sub-grade 12, in the range of the pivot. This causes an oblique positioning of rear frame part 3 which carries track raising device 19 and, since the latter has been locked in position by control 32, track 10 is raised simultaneously. Since undercarriage 7 has been raised with the frame, it is relieved of any load during this track raising operation. This causes the weight of the machine to shift from undercarriage 7 to undercarriage 6, producing extended wheelbase 33 between the two undercarriages 5 and 6 which now support the weight of the machine. This long wheelbase 33 makes it possible for the rails to be elastically deformed according to their flexing characteristics even if the lifting stroke is relatively large, thus avoiding permanent deformations of the rails. The increased lifting stroke made possible by this arrangement enables the immersion depth of horizontal excavation chain course 15 to be reduced, making it possible to excavate only the ballast in the cribs and to a depth of only a few centimeters below the undersides of the ties. Therefore, machine 1 can be used in track sections with a relatively shallow depth 34 of ballast, i.e. a depth less than the usual ballast bed depth of about 20 to 30 cm.

FIG. 3 schematically illustrates in chain-dotted lines that rail 8 can be lifted only by lifting stroke 24 if the wheelbase has only length 23 to avoid permanent deformation of the flexed rail. However, when drive means 27 is operated in the manner described hereinabove in connection with FIG. 2, and particularly if undercarriage 7 is lifted entirely off the track by operation of hydraulic drive 35, which also is connected to sum 31 through control 32, the available lifting stroke is determined by distance 33 between the two weight-supporting undercarriages 5 and 6. This, as shown in broken lines, enables rail 8 to be lifted by increased lifting stroke 36 before permanent deformation occurs. The described and illustrated arrangement of two pivotally connected frame parts pivotal in relation to each other by a drive which can lock the two frame parts in a pivoted position adapts ballast cleaning machine 1 to the most varied operating conditions and thus makes the machine universally useful. It enables a suitable distribution of the machine weight to different types of track-bound undercarriages while making it possible to vary the desired track lifting stroke and ballast excavating depth according to prevailing track conditions.

Existing ballast cleaning machines may be readily and relatively inexpensively converted to the structure of the machine of the present invention, substantially by using the existing machine as the rear frame part and coupling a front frame part thereto in the illustrated manner, with drives 28 connected between the frame parts. Clearly, this is independent of the specific ballast cleaning system used.

While hydraulic drives have been described and illustrated, any suitable drive means may be used, of course, including such mechanical drives as threaded spindles-and-nuts. The drive for propelling machine 1 may also take any suitable form. Thus, the wheels of all undercarriages may be driven or, if desired, only the wheels of the undercarriages supporting the rear frame part. The best distribution of weight will be achieved if the heavy power plant is mounted on front frame part 4 so that rear frame part 3 will be subjected only to the load of the ballast cleaning and redistributing means. Finally, track raising device 19 may simply be a rail gripping mechanism without its own lifting drive, in which case the track will be raised only by the pivoting of the frame part which carries this mechanism.

What is claimed is:

1. A self-propelled machine for cleaning ballast supporting a railroad track and comprising (a) a machine frame comprised of two frame parts having abutting ends, (b) a pivotal connection between the abutting ends of the frame parts and arranged to enable pivotal movement of the frame parts in vertical and horizontal directions, (c) a drive means interconnecting the abutting frame part ends and operable to effectuate the pivotal movement in at least one of said directions, (d) three track-bound undercarriages supporting the machine frame on the track, (1) one of the undercarriages being arranged at the pivotal connection and being vertically adjustable with the two frame parts, (e) means mounted on the machine frame for receiving the ballast, cleaning the received ballast and redistributing the cleaned ballast, said means including (1) a ballast excavation chain comprising a horizontal course immersible in the ballast below the track, (2) a ballast screening mechanism for cleaning the ballast and arranged to receive ballast from the ballast excavation chain, and (3) respective conveyor means for redistributing the cleaned ballast and for removing waste, the conveyor means being arranged to receive the cleaned ballast and the waste, respectively, from the ballast sceening mechanism, and (f) a device for raising the track arranged in the range of the horizontal course of the ballast excavation chain.

2. The self-propelled ballast cleaning machine of claim 1, wherein the on track-bound undercarriage is a swivel truck.

3. The self-propelled ballast cleaning machine of claim 1 or 2, wherein the track raising device includes means for laterally moving the track.

4. The self-propelled ballast cleaning machine of claim 1 or 2, wherein the drive means is arranged to lock the frame parts in respective end positions of the pivotal movement.

5. The self-propelled ballast cleaning machine of claim 4, wherein the drive means comprises two hydraulically operable cylinder-piston drives, each of said drives extending above the pivotal connection at a respective side of the machine frame, the cylinder of each drive having an end linked to one of the abutting frame part ends and the piston of each drive having an end linked to the other abutting frame part end.

6. The self-propelled ballast cleaning machine of claim 1 or 2, further comprising a drive for vertically adjusting the one track-bound undercarriage in relation to the machine frame.

7. The self-propelled ballast cleaning machine of claim 2, wherein another one of the track-bound undercarriages is a swivel truck, the swivel trucks supporting a rear one of the frame parts, as seen in an operating direction of the machine, and the means for receiving, cleaning and redistributing the ballast as well as the track raising device are mounted on the rear frame part.

8. The self-propelled ballast cleaning machine of claim 7, wherein the distance between the swivel trucks supporting respective ends of the rear frame part is greater than the distance between the one swivel truck and the track-bound undercarriage supporting respective ends of the other frame part.

9. The self-propelled ballast cleaning machine of claim 8, wherein the distance between the swivel trucks is substantially twice the distance between the one swivel truck and the track-bound undercarriage supporting respective ends of the other frame part.

* * * * *